US010100504B2

(12) United States Patent
Lee

(10) Patent No.: US 10,100,504 B2
(45) Date of Patent: Oct. 16, 2018

(54) BIDET APPARATUS

(71) Applicant: COWAY CO., LTD, Chungcheongnam-do (KR)

(72) Inventor: Sung-Hee Lee, Seoul (KR)

(73) Assignee: COWAY CO., LTD., Chungcheongham-do (KR)

( * ) Notice: Subject to any disclaimer, the term of this patent is extended or adjusted under 35 U.S.C. 154(b) by 0 days.

(21) Appl. No.: 15/318,723

(22) PCT Filed: Jun. 23, 2015

(86) PCT No.: PCT/KR2015/006382
§ 371 (c)(1),
(2) Date: Dec. 14, 2016

(87) PCT Pub. No.: WO2015/199419
PCT Pub. Date: Dec. 30, 2015

(65) Prior Publication Data

US 2017/0114530 A1 Apr. 27, 2017

(30) Foreign Application Priority Data

Jun. 25, 2014 (KR) ..... 10-2014-0078393

(51) Int. Cl.
*A47K 10/48* (2006.01)
*E03D 9/08* (2006.01)

(52) U.S. Cl.
CPC ..... *E03D 9/08* (2013.01); *A47K 10/48* (2013.01)

(58) Field of Classification Search
CPC ..... E03D 9/08
USPC ..... 4/443–448
See application file for complete search history.

(56) References Cited

U.S. PATENT DOCUMENTS 5,991,937 A * 11/1999 Safara ..... E03D 9/085 239/315
2004/0025248 A1* 2/2004 Lang ..... E03C 1/05 4/623
2012/0005817 A1* 1/2012 Jeong ..... C02F 1/4674 4/420.4
2014/0137318 A1* 5/2014 Dorra ..... E03D 9/08 4/233

FOREIGN PATENT DOCUMENTS

| | | |
|---|---|---|
| JP | 2009209532 | 9/2009 |
| KR | 0132759 | 12/1998 |
| KR | 20050014089 | 2/2005 |
| KR | 20090076192 | 7/2009 |
| KR | 20120003734 | 5/2012 |

OTHER PUBLICATIONS

International Search Report PCT/KR2015/006382, dated Aug. 13, 2015 (4 pages).

* cited by examiner

*Primary Examiner* — Christine Skubinna
(74) *Attorney, Agent, or Firm* — Dority & Manning, P.A.

(57) ABSTRACT

A bidet apparatus according to an embodiment of the present invention may comprise: a nozzle case provided inside of a frame; a nozzle, provided in the nozzle case so as to be movable forward and backward, having a discharge outlet at one end thereof; and a drier, provided inside of the frame, for spraying air toward the discharge outlet. As such, a user can dry a nozzle discharge cutlet by only a simple button operation.

9 Claims, 9 Drawing Sheets

【FIG 1】
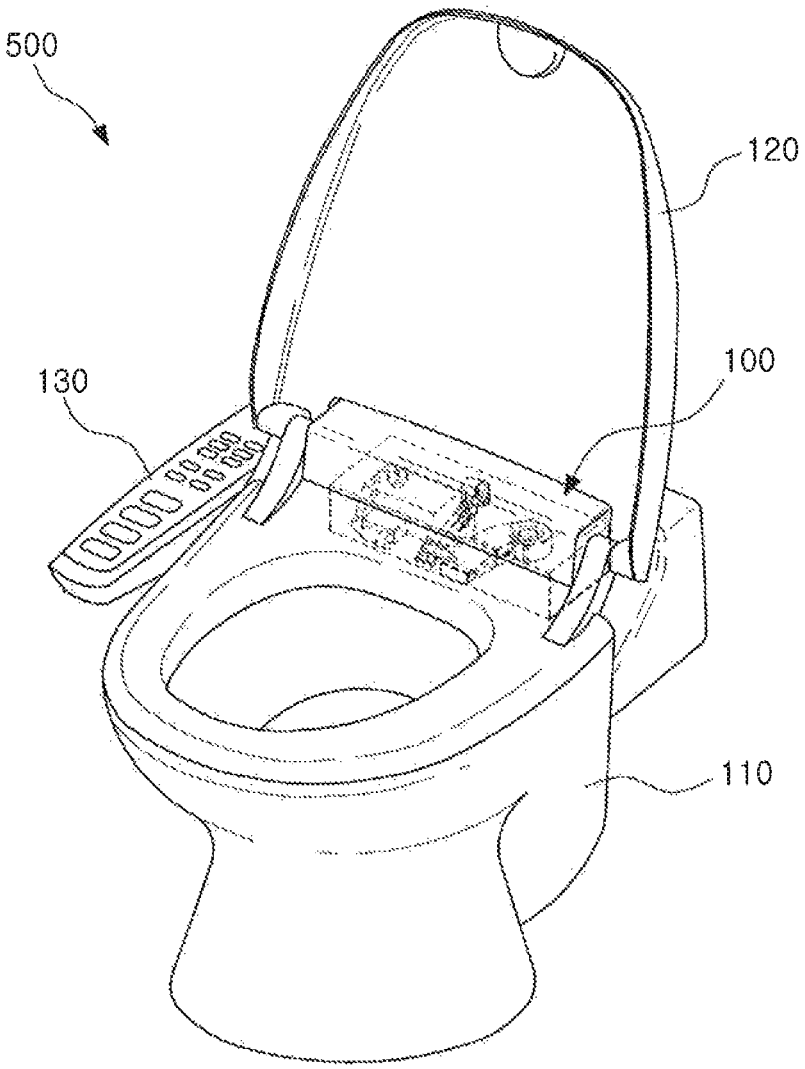

【FIG 2】
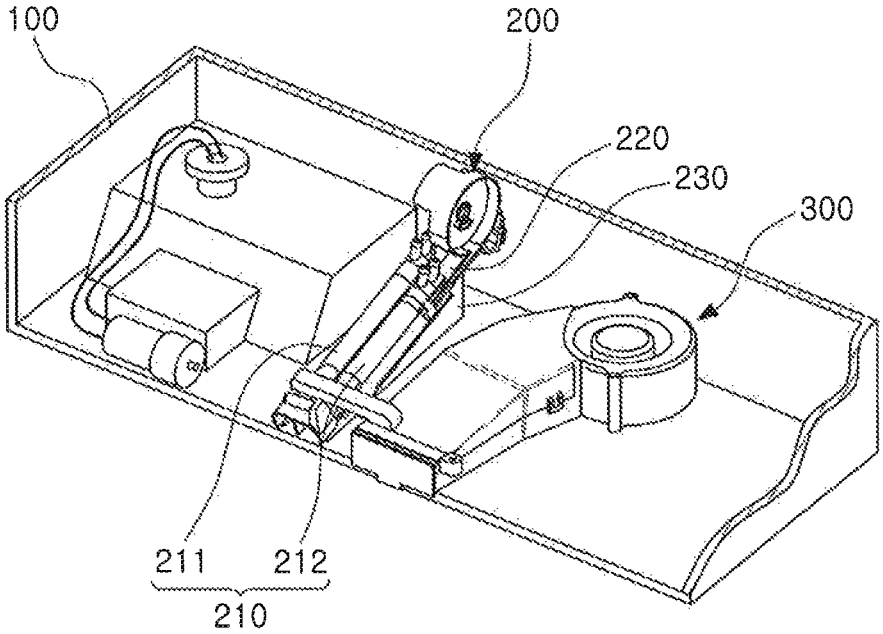

【FIG 3】
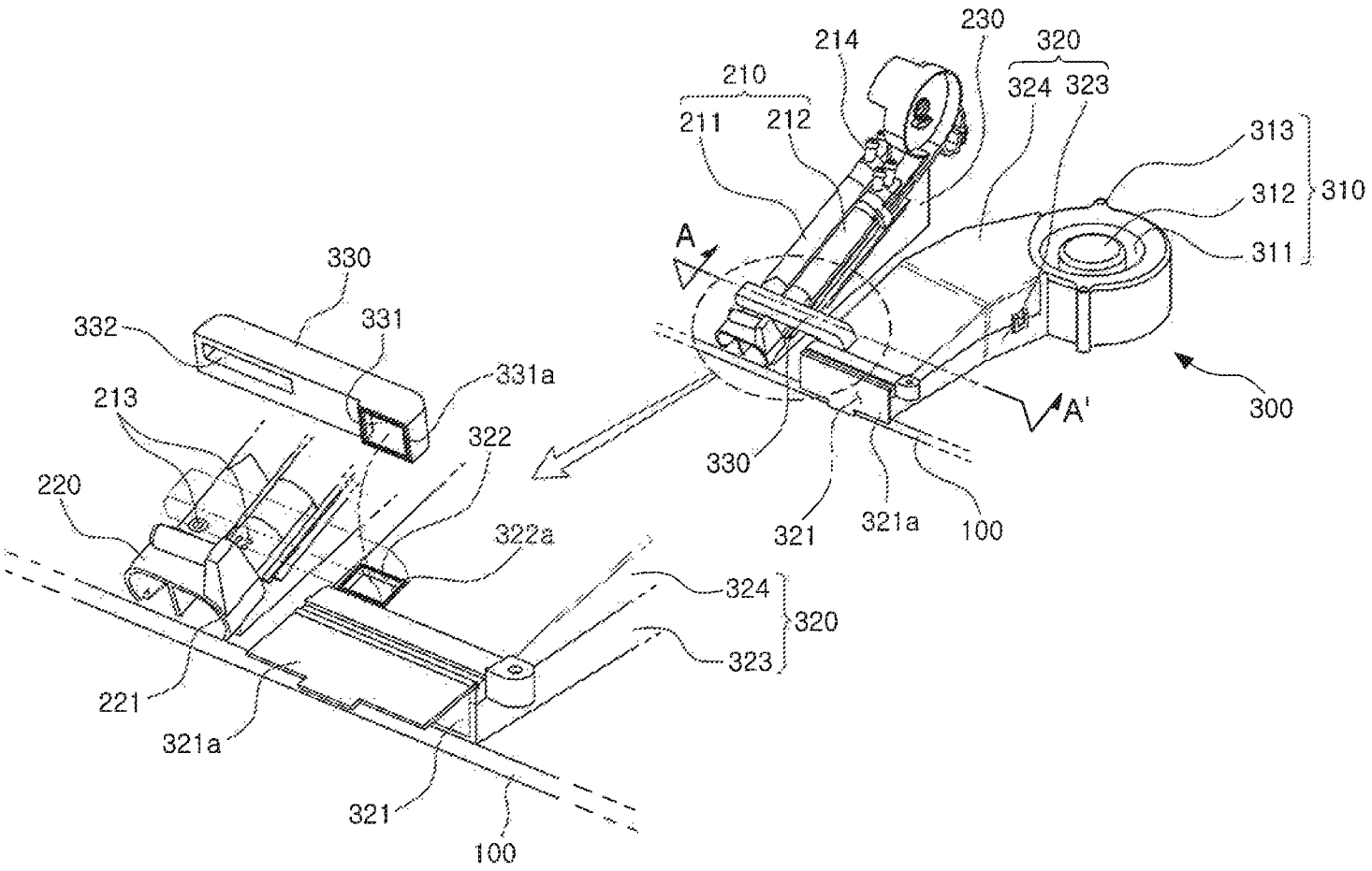

【FIG 4】
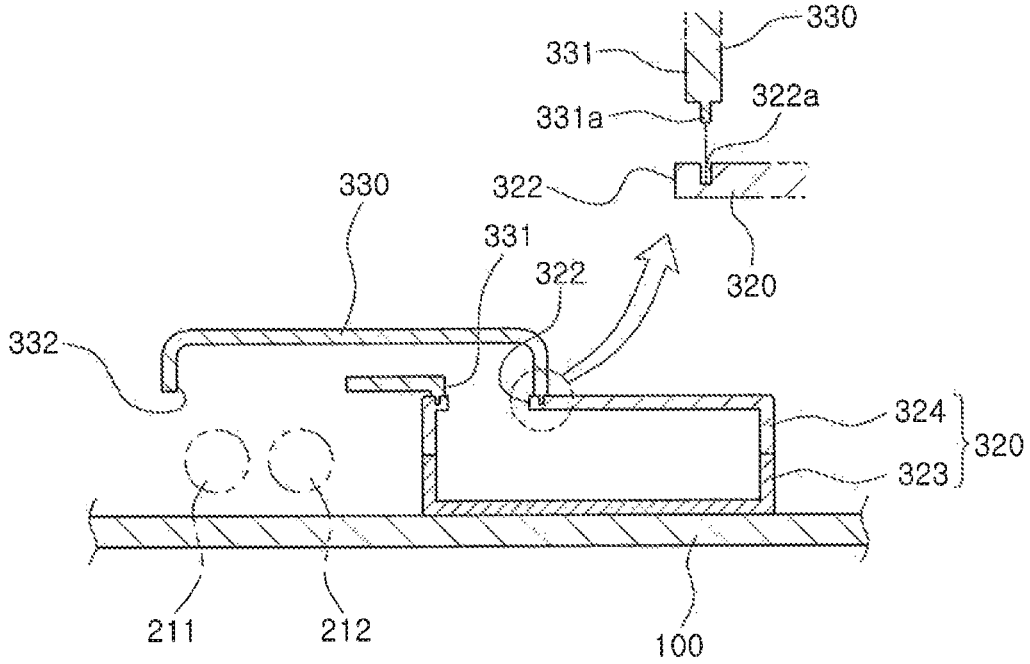
【FIG 5】
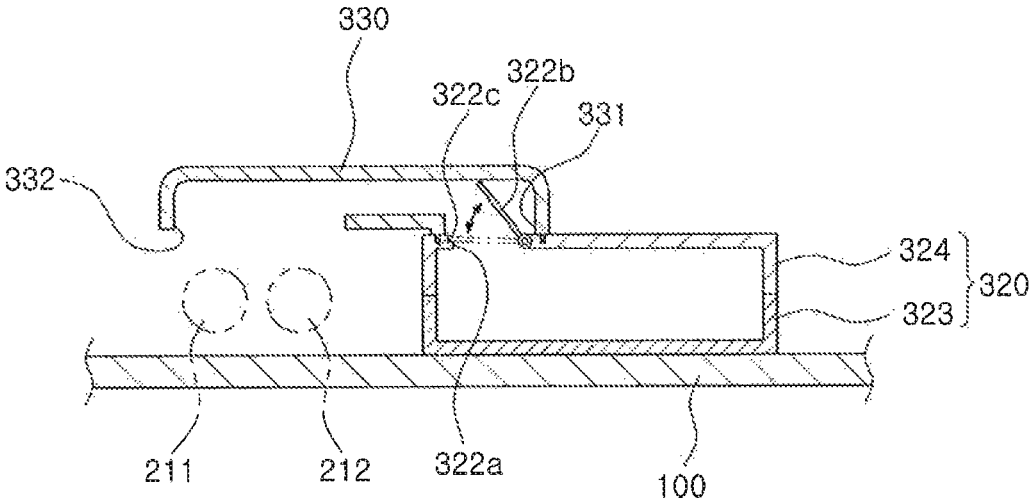
A-A

【FIG 6】
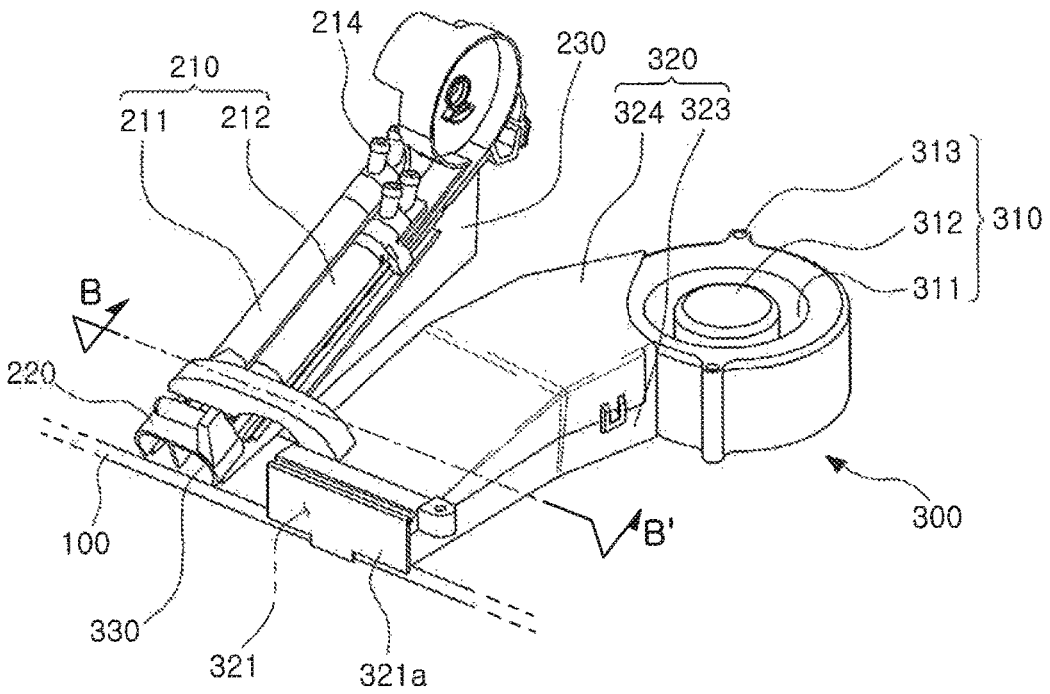
【FIG 7】
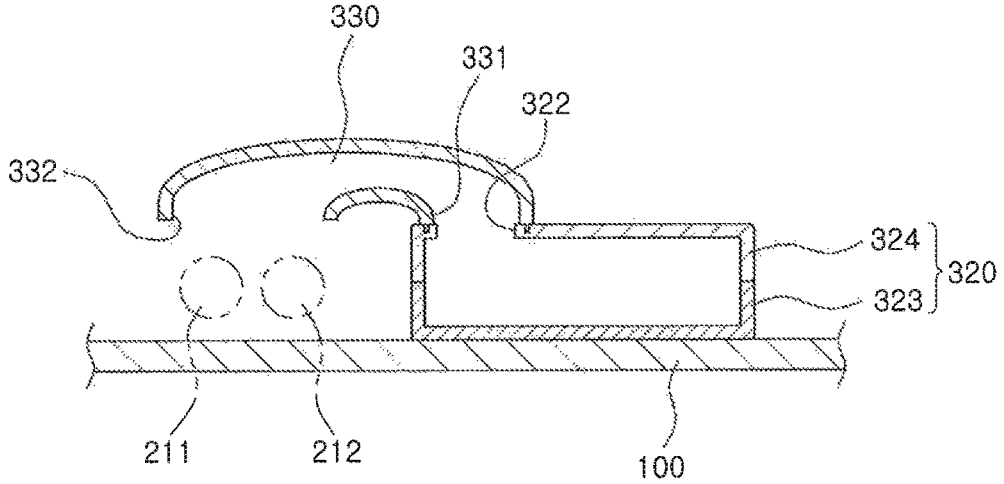
B-B

【FIG 8】
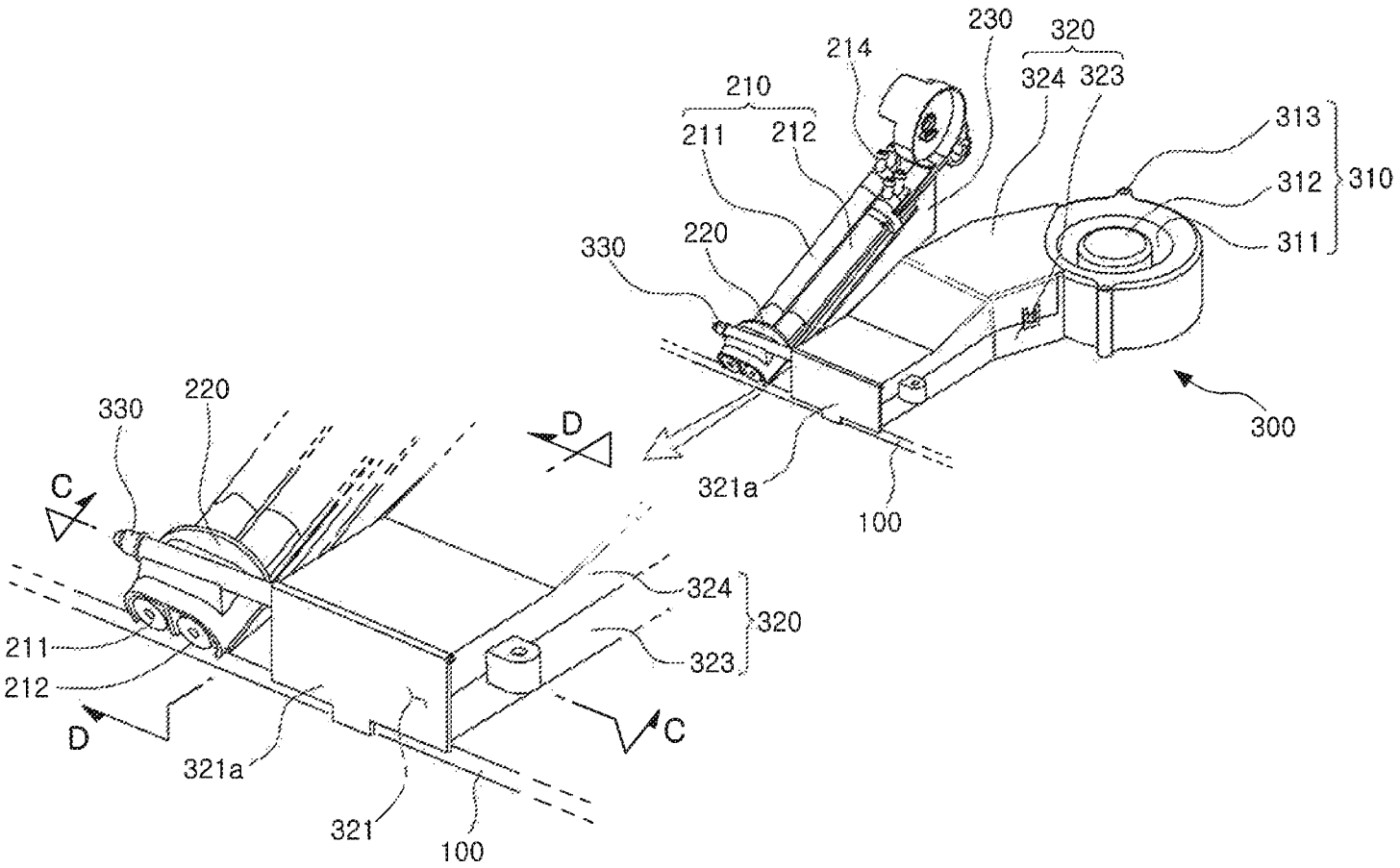

【FIG 9】
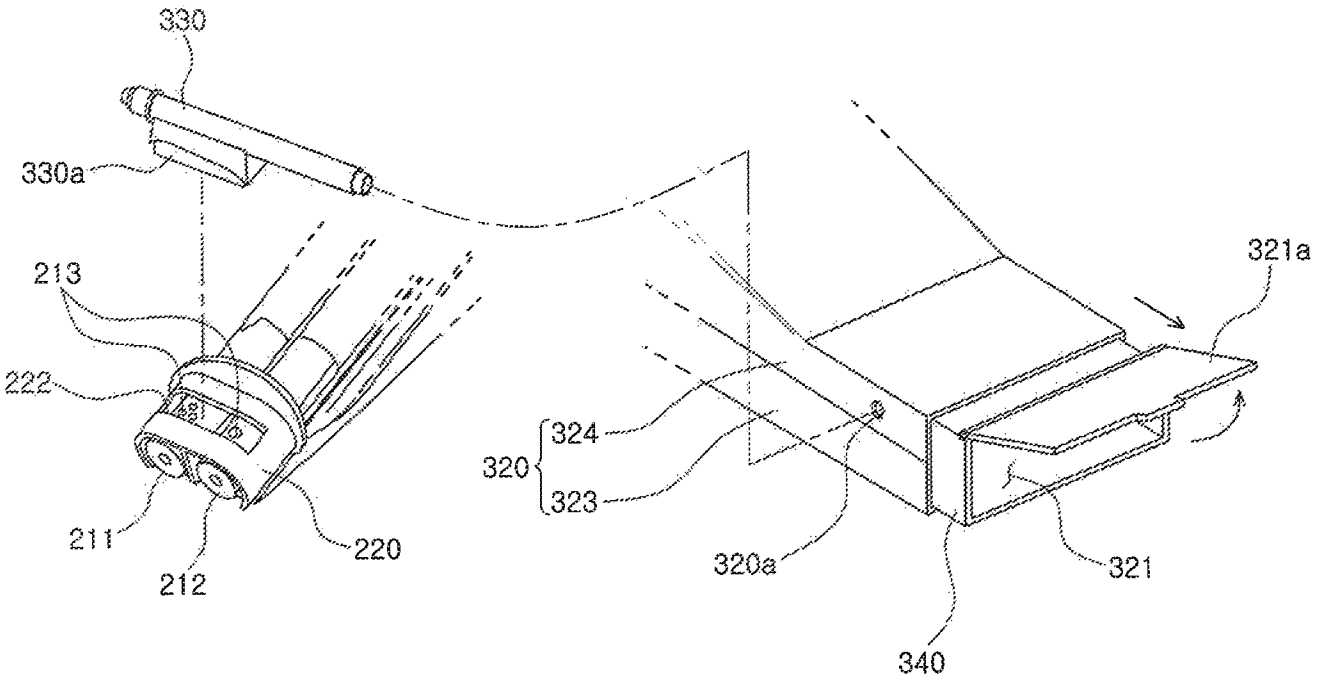

【FIG 10】
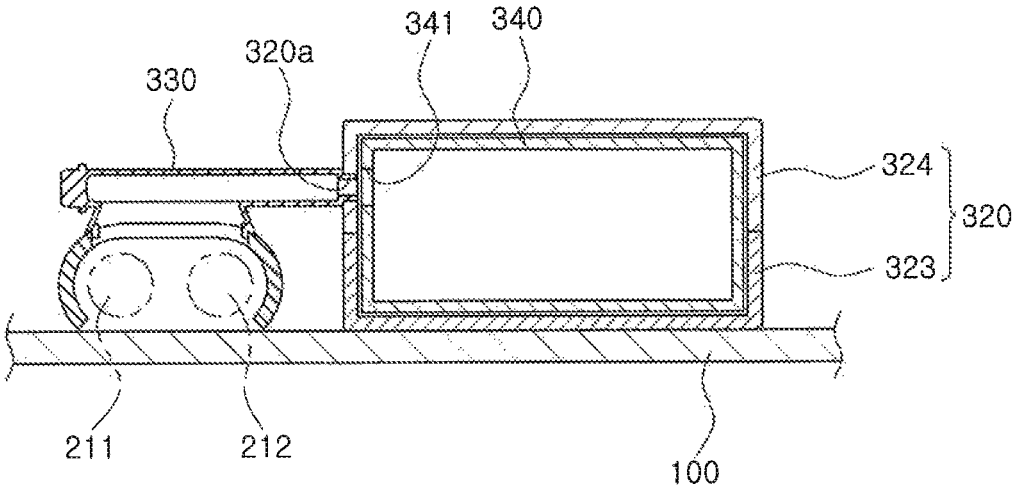
C-C
【FIG 11】
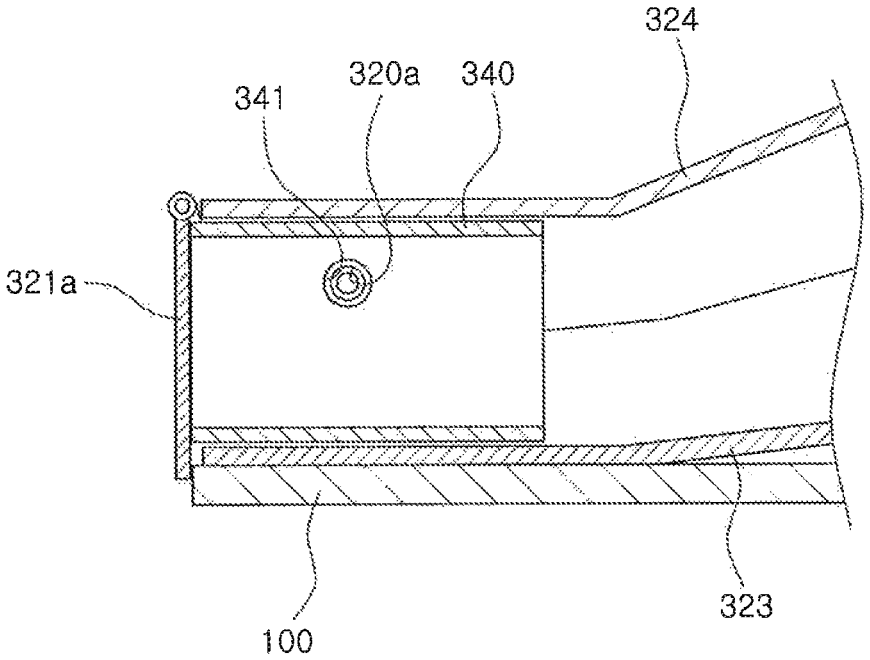
D-D

【FIG 12】
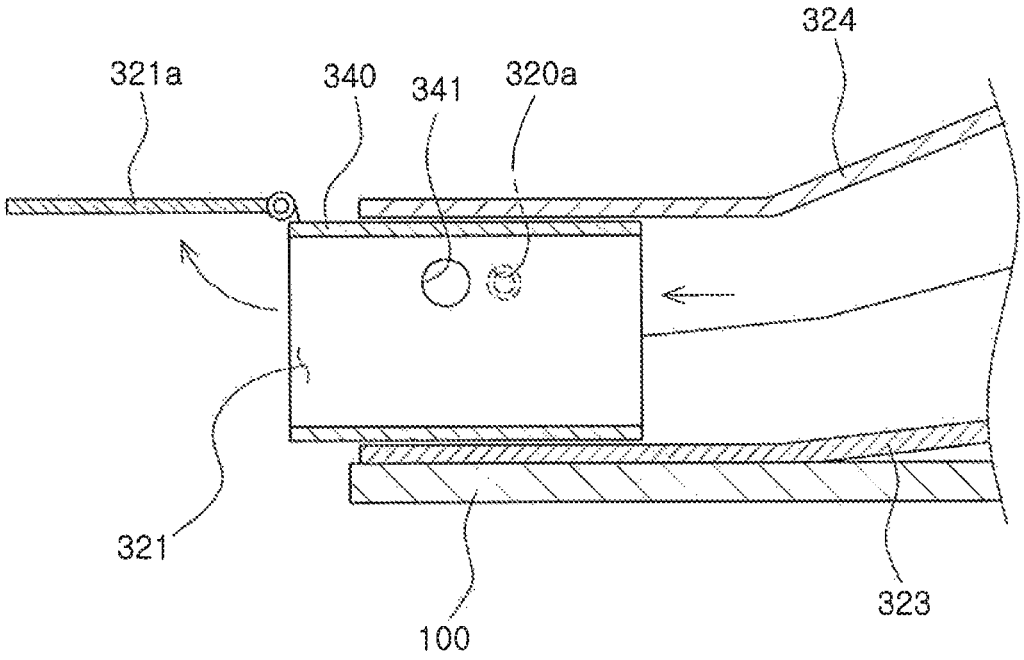
D-D

BIDET APPARATUS

TECHNICAL FIELD

The present disclosure relates to a bidet apparatus, and more particularly, to a bidet apparatus having a nozzle dryer.

BACKGROUND ART

In general, bidets installed in toilet seats clean local portions of a user's anatomy, such as the genitals and anus, by dispensing cleansing water from a central portion of a bidet apparatus. Recently, bidet apparatuses have been increasingly used in domestic households.

In the case of such bidet apparatuses, when a cleaning operation of a bidet apparatus is initiated by a user, a cleaning nozzle of the bidet apparatus moves forward to the outside of a bidet body, and the cleaning nozzle, having received washing water from a water supply device, provides the washing water to the genitals or anus of the user to perform washing.

Meanwhile, in the related art bidet apparatuses, a cleaning-nozzle outlet for dispensing supplied water is provided on a front end of a cleaning nozzle, and a nozzle cleaning portion for cleaning the cleaning-nozzle outlet is provided above the cleaning nozzle outlet.

In addition, such a cleaning-nozzle outlet has been commonly used in a natural drying manner without passing through a separate drying operation after the washing thereof in a washing section.

Thus, it takes a considerable amount of time to dry the cleaning-nozzle outlet, and a problem in which sanitary conditions are degraded has occurred.

DISCLOSURE

Technical Problem

An aspect of the present disclosure is to provide a bidet apparatus including a drying device for drying a nozzle outlet.

Technical Solution

According to an aspect of the present disclosure, a bidet apparatus includes a nozzle case provided inside a frame, a nozzle provided in the nozzle case to be movable forwardly and backwardly, and provided with a discharge outlet formed in an end of the nozzle, and a drying device provided inside the frame and dispensing air to the discharge outlet.

The drying device may include an air blower generating a flow of air, a drying duct coupled to the air blower to provide a passage through which the air generated by the air blower flows, and a branch duct provided on one side of the drying duct to guide air to the discharge outlet.

The one side of the drying duct coupled to the branch duct may be provided with an opening formed therein, and the drying duct and the branch duct may communicate with each other.

At the opening, an opening and closing member may be hinged to be rotatably movable.

An outer surface of the branch duct may be curved.

The branch duct may be coupled to the drying duct by a bonding scheme using an adhesive or a press-fitting scheme.

An entrance of the branch duct may be provided with a press-fitting projection to be press fitted to the drying duct, and the drying duct may be provided with a slit into which the press-fitting protrusion is press fitted.

The drying duct may be provided with a dispensing nozzle through which air is discharged to the outside of the frame, and the drying duct may be provided with a duct cover disposed on one side of the drying duct in which the dispensing nozzle is provided.

The drying device may be provided with a sliding portion slidably moved forwardly and rearwardly in an inner side of the drying device, to control a dispensing direction of air.

The branch duct may be insertedly coupled to the nozzle case.

Advantageous Effects

A bidet apparatus according to an exemplary embodiment in the present disclosure may include a drying device dispensing air to a discharge outlet of a nozzle, thereby quickly drying the discharge outlet of the nozzle.

DESCRIPTION OF DRAWINGS

FIG. 1 is a schematic perspective view of a toilet seat combined with a bidet apparatus according to an exemplary embodiment in the present disclosure.

FIG. 2 is a partially cutaway perspective view of a frame according to an exemplary embodiment in the present disclosure.

FIG. 3 is a schematic perspective view illustrating a drying device and a nozzle assembly in a bidet apparatus according to an exemplary embodiment in the present disclosure.

FIG. 4 is a cross-sectional view taken along line A-A' of FIG. 3.

FIG. 5 is a cross-sectional view taken along line A-A' of FIG. 3 according to another exemplary embodiment in the present disclosure.

FIG. 6 is a schematic perspective view of a drying device and a nozzle assembly in a bidet apparatus according to another exemplary embodiment in the present disclosure.

FIG. 7 is a cross-sectional view taken along line B-B' of FIG. 6.

FIG. 8 is a perspective diagram of a drying device according to another exemplary embodiment in the present disclosure.

FIG. 9 is an exploded perspective diagram of a drying device according to another exemplary embodiment in the present disclosure.

FIG. 10 is a cross-sectional view taken along line C-C' of FIG. 8.

FIG. 11 is a cross-sectional view taken along line D-D' of FIG. 8.

FIG. 12 is a cross-sectional view illustrating a state in which a sliding portion in FIG. 11 has been moved forward.

BEST MODE

Prior to the detailed description of the present disclosure, the terms or words used in the present specification and claims should not be construed as being limited to ordinary or dictionary meanings, and should be interpreted as having meanings and as being conceptually consistent with the technical idea of the present disclosure, based on the principle that the inventor can appropriately define the terms of his invention in order to describe his own invention in the best manner possible. Thus, the embodiments described in the present specification and the configurations illustrated in the drawings are merely the preferred embodiments of the present disclosure and are not intended to represent all of the technical ideas of the present disclosure. Therefore, it should be understood that various equivalents and variations thereof may be possible.

Hereinafter, exemplary embodiments in the present disclosure will be described in detail with reference to the accompanying drawings. In the drawings, the same reference numerals will be used throughout to designate the same or like elements. Further, the detailed description of well-known functions and constructions that may obscure the gist of the present disclosure will be omitted. For the same reason, some of the components in the accompanying drawings may be exaggerated, omitted, or schematically illustrated, and the depicted dimensions of respective components may not accurately reflect the actual size of the components.

FIG. 1 is a schematic perspective view of a toilet seat combined with a bidet apparatus according to an exemplary embodiment, FIG. 2 is a partially cutaway perspective view of a frame according to an exemplary embodiment, FIG. 3 is a schematic perspective view illustrating a drying device and a nozzle assembly in a bidet apparatus according to an exemplary embodiment, and FIG. 4 is a cross-sectional view taken along line A-A' of FIG. 3.

With reference to FIGS. 1 to 4, a bidet apparatus according to an exemplary embodiment may include a frame 100, a nozzle assembly 200, and a drying device 300.

The nozzle assembly 200 may be provided inside the frame 100. The nozzle assembly 200 may be movable forwardly and rearwardly of a toilet seat 10 and may include a nozzle 210 dispensing washing water for cleaning the genitals or anus of a user.

A seat member 110 may be rotatably hinged to the frame 100, and the seat member 110 may be mounted on the toilet seat 10 by a user or may be lifted from the toilet seat 10 by the user, as required.

In addition, although not illustrated in the drawings, a hose in which a hot wire is disposed or through which hot water flows may be provided inside the seat member 110 to maintain the seat member 110 at a predetermined temperature.

On the other hand, a cover 120 may be rotatably hinged to the frame, and the cover 120 may open or close the toilet seat 10 through rotation of the cover 120. The cover 120 may prevent foreign matter from entering the inside of the toilet seat, and may prevent odors generated in the toilet seat 10 from diffusing outwardly of the toilet seat 10.

In addition, an operation unit 130 controlling an overall operation of a bidet apparatus 500, for example, the nozzle assembly 200, the drying device 300, and the like, may be provided on one side of the frame 100.

The operation unit 130 may be provided with a plurality of buttons, in such a manner that a predetermined function may be selected by a user as needed. Briefly describing a process of cleaning a user's anatomy, such as the genitals or anus, for example, when a user presses a cleaning button provided on the operation unit 130, the nozzle 210 may move forwardly of the toilet seat 10 to dispense washing water to local portions of a user's anatomy. When the user presses a drying button after the local washing using washing water is finished, air is blown from the nozzle of the drying device 200 to be described later to remove the water remaining on local portions of the user's anatomy.

The nozzle assembly 200 may include a nozzle 210, a nozzle case 220, and a nozzle case support 230.

The nozzle case support 230 may be formed to have an inclined upper surface inclined downward toward the front, in such a manner that the nozzle case support is installed on a bottom surface of the frame 100, inside the frame 100. The nozzle case 220 may be mounted on the inclined upper surface of the nozzle case support to be combined with each other.

For example, the nozzle case 220 may be provided inside the frame 100 and may be provided to be inclined downward toward the front on the upper portion of the nozzle case support 230. In this case, the nozzle case 220 may be coupled to the nozzle case support 230 by a bonding method using an adhesive or a hook coupling method, and the nozzle case 220 and the nozzle case support 230 may also be integrally formed.

On the other hand, the nozzle 210 may be coupled to the nozzle case 220 to be movable forwardly and backwardly, and a guide hole 221 may be formed in one end of the nozzle case 220 in such a manner that the nozzle 210 may be slidable thereon.

The nozzle 210 may be provided with the nozzle case 220 to be movable forwardly and rearwardly by dispensing washing water to the anus or pudendum of a user, and may include a cleaning nozzle 211 for the anus and a bidet nozzle 212 for female.

In this case, a discharge outlet 213 dispensing water supplied from a water supply device may be provided in one ends of the cleaning nozzle 211 and the bidet nozzle 212, and a nozzle connector 214 may be provided on the other ends of the cleaning nozzle 211 and the bidet nozzle 212 to be connected to a hose to receive water from the water supply device.

For example, the water supplied from the water supply device may be supplied to the nozzle 210 through the nozzle connector 214 and may then be dispensed through the discharge outlet 213 provided in one end of the nozzle 210.

On the other hand, for example, when washing water is dispensed from the discharge outlet 213 as described above, a relatively large amount of water may remain around the discharge outlet 213. In a case in which such water is not properly dried, a problem in which odors and bacteria may be generated may be present.

However, the bidet apparatus 200 according to an exemplary embodiment in the present disclosure may prevent the generation of odors and bacteria by drying the discharge outlet 213 and a periphery of the discharge outlet 213 using the drying device 300 to be described later.

The drying device 300 may be installed inside the frame 100 to blow air to local portions of a users and the discharge outlet 213. The drying device 300 may include an air blower 310, a drying duct 320, and a branch duct 330.

The air blower 310 may be a device generating a flow of air and may include an air inlet 311 through which air is drawn from the outside. The air inlet 311 may be provided in an upper surface of the air blower 310. Air may be drawn into the air blower 310 through the air inlet 311 by an operation of a fan 312 installed inside the air blower 310.

In this case, the fan 312 may be a centrifugal fan radially discharging air being drawn in an axial direction, and may be driven by a fan motor.

Then, the air drawn through the air inlet 311 may be heated while passing through a heating device (not shown) provided inside the drying duct 320, and the heated air may move to a dispensing nozzle to then be discharged to the outside of the frame 100.

On the other hand, a plurality of fasteners 313 may be provided on an outer circumferential surface of the air blower 310 to be fixed to the frame 100. For example, the air blower 310 may be mounted in the frame 100 in such a manner that a fixing member 313 thereof is disposed on an upper portion of a fixing boss (not shown) formed in the frame 100, and the fixing member 313 and the fixing boss may be fastened to each other using a screw.

The drying duct 320 may be installed on a side of the air blower 310 and an air passage may be formed therein toward the dispensing nozzle 321. For example, the drying duct 320 may include a lower housing 323 having an open upper portion and an upper housing 324 having an open lower portion. The lower and upper housings 323 and 324 may be combined with each other by a fastening member, to provide a passage through air flows.

In addition, an opening 322 may be formed in one side of the upper housing 324, in detail, in a side thereof to which the branch duct 330 to be described later is coupled.

In this case, the upper housing 324 having the opening 322 may be provided with a slit 322*a* formed along an edge of the opening 322. For example, the branch duct 330 may be press-fitted into the slit 322*a*, but is not limited thereto, and the branch duct 330 may be coupled to the drying duct 320 via a bonding method using an adhesive.

On the other hand, with reference to FIG. 5, an opening and closing member 322*b* may be hinged at the opening 322 to be rotatably movable, and the opening and closing member 322*b* may guide air blown from the air blower 310 to the branch duct 330.

For example, the opening and closing member 322*b* may be mounted on a stop protrusion 322*c* of the drying duct 320, and may allow the drying duct 320 and the branch duct 330 to be separated from each other.

In addition, for example, when a drying function of the discharge outlet is performed, the opening and closing member 322*b* may rotate inwardly of the branch duct 330 to open the opening 322*b* and guide the air to the branch duct 330.

Further, the drying duct 320 may be provided with the dispensing nozzle 321, disposed in one end of the drying duct 320, through which air is discharged to the outside of the frame 100. A duct cover 321*a* may be provided on one side of the drying duct 320 in which the dispensing nozzle 321 is disposed to be hinged thereto.

In addition, a heating device (not shown) heating air blown from the air blower 310 may be provided in the drying duct 320. In this case, as the heating device, any device capable of emitting heat to heat air may be used.

The branch duct 330 may be provided on one side of the drying duct 320 to guide air to the discharge outlet 213. The branch duct 330 may include an air inlet 331 through which air from the drying duct 320 enters, and an air outlet 332 dispensing air to the discharge outlet 213 of the nozzle 210.

At this time, the air inlet 331 may be provided with a press-fitting projection 331*a* protruding along an edge of the air inlet 331. For example, the branch duct 330 and the drying duct 320 may be coupled to each other by press-fitting the press-fitting protrusion 331*a* into the slit 322*a* of the drying duct 320.

However, an exemplary embodiment in the present disclosure is not limited thereto. For example, the branch duct 330 and the drying duct 320 may be coupled to each other using various coupling methods, such as a method of applying an adhesive to the air inlet 331, a hook coupling method, or the like.

As a result, the branch duct 330 and the drying duct 320 may be coupled to each other to thus communicate with each other.

Further, the air outlet 332 may be disposed to face the discharge outlet 213 of the nozzle 210. Thus, air having entered through the air inlet 331 may be dispensed to the discharge outlet 213 and the periphery thereof through the air outlet 332.

For example, when a discharge outlet drying function is performed by a user, air blown from the air blower 310 may move to the drying duct 320, and may then move to the branch duct 330 through the opening 322 of the drying duct 320, and resultantly, may be dispensed to the discharge outlet 213 and a periphery thereof through the air outlet 332. Thus, the discharge outlet 213 and the periphery thereof may be dried only via a simple button operation by the user.

When the discharge outlet 213 is dried after a cleaning operation as described above, contaminants may be prevented from propagating around the discharge outlet 213, compared with the case in which the discharge outlet 213 is not dried.

FIGS. 6 and 7 illustrate a modified example of the branch duct 330. For example, with reference to FIGS. 6 and 7, an outer surface of the branch duct 330 may be curved.

In the case in which the outer surface of the branch duct 330 is curved, a reduction in kinetic energy due to collisions between air and the branch duct 330 may be significantly decreased, thereby improving a discharge outlet drying performance.

FIG. 8 is a perspective diagram of a drying device according to another exemplary embodiment in the present disclosure, FIG. 9 is an exploded perspective diagram of a drying device according to another exemplary embodiment in the present disclosure, FIG. 10 is a cross-sectional view taken along line C-C' of FIG. 8, and FIG. 11 is a cross-sectional view taken along line DD' of FIG. 8.

With reference to FIGS. 8 to 11, a drying device 300 according to another exemplary embodiment may include an air blower 310, a drying duct 320, and a branch duct 330. In addition, except for the drying duct 320 and the branch duct 330 of the drying device 300 with reference to FIGS. 8 to 11, the remaining configurations are identical to those of the drying device 300 with reference to FIGS. 1 to 7.

A detailed description of the same configurations will be omitted and substituted with the above descriptions.

In the case of the drying device 300 according to another exemplary embodiment, the branch duct 330 may be coupled to the nozzle case 220.

For example, the nozzle case 220 may be provided with a through hole 222 formed therein, to which an insertion portion 330*a* of the branch duct 330 is coupled, and the branch duct 330 may be inserted into the through hole 222 of the nozzle case 220 to be coupled thereto, but are not limited thereto. For example, the branch duct 330 may also be integrally formed with the nozzle case 220.

In this case, one end of the branch duct 330 not coupled to the nozzle case 220 may be inserted into a branch duct coupling hole 320*a* of the drying duct 320 and coupled thereto. Thus, air having passed through the drying duct 320 may be resultantly dispensed to the discharge outlet 213 of the nozzle 210 through the branch duct 330 and the insertion portion 330*a*.

On the other hand, a sliding portion 340 may be provided in the drying duct 320 to be slidable forwardly and backwardly, and a duct cover 321*a* may be hinged to one side of the sliding portion 340.

In this case, the drying device 300 according to the exemplary embodiment may allow for adjustment of a direction in which air is dispensed by a movement of the sliding portion 340.

In detail, with reference to FIGS. 11 and 12, the sliding portion 340 may be provided with an air discharge hole 341. The air discharge hole 341 may coincide with a branch duct coupling hole 320*a* of the drying duct 320 in a state in which the sliding portion 340 is completely drawn into the drying duct 320.

Thus, an air flow generated in the air blower 310 may move to the branch duct 330 along the drying duct 320 and the air discharge hole 341.

In a different manner, for example, when the sliding portion 340 is moved forwardly of the drying duct 320, the air discharge hole 341 and the branch duct coupling hole 320*a* may not communicate with each other, and the air may only move to the dispensing nozzle 321 of the drying duct 320.

For example, the opening and closing of the branch duct coupling hole 320*a* may be controlled by the movement of the sliding portion 340.

The sliding portion 340 as described above may be electrically and physically connected to a separate driving device (not shown) and the operation unit 130. In addition, as a position of the sliding portion 340 may be adjusted by a user as necessary, a nozzle drying function and a drying function for local portions of a user's anatomy may be used.

While exemplary embodiments have been shown and described above, it will be apparent to those skilled in the art that modifications and variations could be made without departing from the scope of the present disclosure as defined by the appended claims.

The invention claimed is:

1. A bidet apparatus comprising:

a nozzle case provided inside a frame;

a nozzle provided in the nozzle case to be movable forwardly and backwardly, and provided with a discharge outlet formed in an end of the nozzle; and a drying device provided inside the frame and dispensing air to the discharge outlet; wherein the driving device comprises:

an air blower generating a flow of air;

a drying duct coupled to the air blower to provide a passage through which the air generated by the air blower flows; and a branch duct provided on one side of the drying duct to guide air to the discharge outlet.

2. The bidet apparatus of claim 1, wherein the one side of the drying duct coupled to the branch duct is provided with an opening formed therein, and the drying duct and the branch duct communicate with each other.

3. The bidet apparatus of claim 2, wherein at the opening, an opening and closing member is hinged to be rotatably movable.

4. The bidet apparatus of claim 1, wherein an outer surface of the branch duct is curved.

5. The bidet apparatus of claim 1, wherein the branch duct is coupled to the drying duct by a bonding scheme using an adhesive or a press-fitting scheme.

6. The bidet apparatus of claim 1, wherein an entrance of the branch duct is provided with a press-fitting projection to be press fitted to the drying duct, and the drying duct is provided with a slit into which the press-fitting protrusion is press fitted.

7. The bidet apparatus of claim 1, wherein the drying duct is provided with a dispensing nozzle through which air is discharged to the outside of the frame, and the drying duct is provided with a duct cover disposed on one side of the drying duct in which the dispensing nozzle is provided.

8. The bidet apparatus of claim 1, wherein the drying device is provided with a sliding portion slidably moved forwardly and rearwardly in an inner side of the drying device, to control a dispensing direction of air.

9. The bidet apparatus of claim 1, wherein the branch duct is insertedly coupled to the nozzle case.

* * * * *